United States Patent [19]

Risberg, Jr.

[11] 4,076,235

[45] Feb. 28, 1978

[54] ENTERTAINMENT AND EXERCISE DEVICE

[76] Inventor: Carl Risberg, Jr., 160 Hampshire, Beaconsfield, Quebec, Canada

[21] Appl. No.: 600,452

[22] Filed: Jul. 30, 1975

[51] Int. Cl.[2] ..... A63G 1/12

[52] U.S. Cl. ..... 272/33 A; 272/115

[58] Field of Search ..... 272/33 A, 33 R, 115, 272/146, 1 R; 280/206, 205

[56] References Cited

U.S. PATENT DOCUMENTS

| | | | |
|---|---|---|---|
| 1,656,637 | 1/1928 | Hudson | 272/33 A |
| 2,199,915 | 5/1940 | Howard | 272/33 A X |
| 2,471,528 | 5/1949 | Kling | 272/33 A X |
| 2,615,495 | 10/1952 | Hilliker | 272/33 A |
| 2,804,123 | 8/1957 | Kling | 272/33 A |
| 2,878,858 | 3/1959 | Winchester | 272/33 A |
| 3,083,979 | 4/1963 | Boyd | 272/115 X |
| 3,145,990 | 8/1964 | Prouty | 272/33 R |
| 3,380,735 | 4/1968 | Rigby | 272/33 A |
| 3,460,828 | 8/1969 | Curlee | 272/33 R |
| 3,477,713 | 11/1969 | Cudmore | 272/33 A |
| 3,586,321 | 6/1971 | Gehrke | 272/146 X |
| 3,612,520 | 10/1971 | Chang | 272/146 |

FOREIGN PATENT DOCUMENTS

| | | | |
|---|---|---|---|
| 654,569 | 12/1962 | Canada | 272/33 A |

OTHER PUBLICATIONS

"Popular Mechanics", Feb. 1962, p. 137.

*Primary Examiner*—Richard J. Apley
*Attorney, Agent, or Firm*—Watson, Cole, Grindle & Watson

[57] ABSTRACT

The present invention provides an entertainment and exercise device comprising an open-topped body formed of at least one body-forming wall, the body-forming wall forming a rounded bottom pivot point and extending upwardly and tapering outwardly therefrom and having a generally elliptical configuration, and a top portion which forms an angle with the vertical axis of the elliptically shaped portion greater than the angle formed by the elliptical portion.

3 Claims, 6 Drawing Figures

ENTERTAINMENT AND EXERCISE DEVICE

The present invention relates to an amusement and exercise device and more particularly, to a toy device.

Generally, it is an object of the present invention to provide a toy device for children and which toy device is safe, economical to manufacture, and can be used in practically any location.

Thus, according to one aspect of the present invention, there is provided a toy device comprising an integral, one-piece, open-topped body formed of at least body-forming wall, said body-forming wall forming a rounded bottom pivot point, said at least one body-forming wall extending upwardly and tapering outwardly from said rounded bottom pivot point and having a generally elliptical configuration, and a top portion of said body-forming wall forming an angle with the vertical axis of said elliptical portion greater than the angle which said elliptical portion forms with said axis.

In a further aspect of the present invention, there is provided a toy device for children adapted for a rotational and rocking movement, said device having a base seating area adapted to receive a child in a seating position, said seating area having a frusto-conical end portion with inwardly and downwardly tapering sides meeting at a rounded apex, said rounded apex forming a pivot point about which said device rotates, said side walls of said frusto-conical portion being adapted to contact a supporting surface whereby said device may be rotated about said pivot point, said sides of the device being extended upwardly forming an upper body portion comprising a generally cylindrical wall connected to the upper end of said frusto-conical end portion and extending a distance sufficient to protect the hand of a child from contact with the supporting surface when said device is rotated and said walls of said frusto-conical portion are in contact therewith.

In greater detail, the toy device of the present invention is one in which a child may lie, sit, or kneel and, by using body motions, propel the device in a rotational and rocking manner. In other words, the device permits the child occupying the same, to roll about in a somewhat circular motion and also, "rock" the device to travel from one point to a further point.

The toy device has a somewhat "bowl-shaped" configuration with a rounded or arcuate end or base portion. Extending from the rounded bottom portion a side wall extends upwardly and tapers outwardly to form a base seating area in which a child may sit or kneel.

The "bowl-shaped" configuration may be of an overall generally elliptical configuration, and in one preferred embodiment, be circular, thus giving a frusto-conical type structure. In this respect, it will be understood that the side wall need not necessarily be the configuration of a regular ellipse in the sense that the side wall may be somewhat undulated. Generally, however, a substantially elliptical configuration is desired The bottom or rounded apex portion of the device ensures that the toy is "unstable" in use and that, in its normal resting position, the device will contact a supporting surface with its side wall. The side wall, tapering outwardly and upwardly from the rounded apex, may do so at an angle of between 30° and 60° with respect to the vertical axis of the elliptical portion. Preferably, the angle is between 40° and 50° . If the angle is too great, the device will have a tendency to "tip over" and render the same unsafe. Also, the walls forming the body of the device may have an angle which varies depending on the location. In other words, initially the body-forming wall may form a relatively large angle with respect to the axis and then change the angle of taper to a greater one.

In the embodiment wherein the device has the overall generally elliptical configuration, it is preferred that the minor axis of the ellipse be at least 80% of the length of the major axis thereof. This ensures that not too great an effort is required by the child occupying the device to set the same in motion.

In playing with the toy device discussed above, and wherein the walls normally contact the supporting surface on which the device is placed, means must be provided for the child to grasp and hold on. The natural reaction of a child occupying the device is to hold on to the uppermost portion of the side walls. Since these walls are in contact with the supporting surface, care must be taken that the fingers of the child do not become caught between the supporting surface and the walls.

Accordingly, in one aspect of the present invention, at the uppermost portion of the side walls, the same are constructed so as to be at a lesser angle with respect to the axis of the elliptical configuration than the angle formed by the elliptical portion. By so doing, the device will rest on the lower portion of the side walls and the upper portion will not contact the supporting surface. In such an embodiment, preferably the rim is formed by an extension of the side walls.

Alternatively, the walls may extend upwardly at a constant angle such that the entire outer surface thereof is in contact with the supporting surface. In this embodiment, handles may be provided on the interior of the device by any suitable means known to those skilled in the art. Thus, for example, handles may be formed integrally with the body or alternatively, means for attaching the same to the body can be provided.

The material forming the device of the present invention may be chosen from any number of suitable materials well known to those skilled in the art. Thus, for example, the device may be formed of various metallic materials, wood, plastics materials, etc. Preferably, for reasons of durability, economy, etc., the device is manufactured from one of the well-known plastics materials such as, for example, polyethylene, polypropylene, etc.

In this respect, the device in usually formed as a one-piece integral unit.

The interior surface of the body-forming wall or in other words, the seating area in which the occupant kneels or sits, may be provided with a plurality of small ridges formed during the manufacturing of the same. These ridges, especially in the embodiment wherein the device is manufactured of a plastics material, help to overcome the smooth slippery surface and prevent the child from sliding out of the toy.

The dimensions of the toy may be any desirable. For most applications, a top diameter of approximately 3 feet with a top portion extending at least a few inches is suitable.

In the preferred embodiment of the present invention, the body-forming wall, or a least a portion thereof, is apertured. These apertures will prevent suffocation by the child should the device tip over or is otherwise placed over the child. The spaced apart apertures may be of any configuration and size and preferably, extend over a substantial portion of the body-forming wall without weakening the structural integrity thereof.

It is believed that the objects and advantages of the present invention will become clear from the following description of one embodiment thereof, taken in conjunction with the accompanying drawings, in which.

Figure 1:
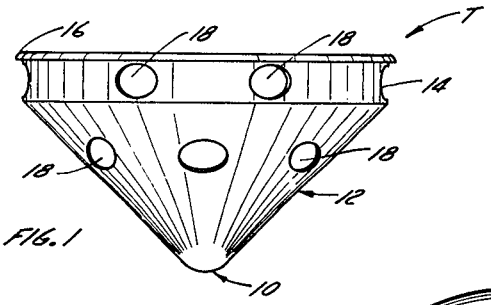
FIG. 1 is a side elevational view of one embodiment of the present invention.
Figure 4:
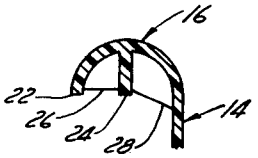
FIG. 4 is a cross sectional detail view of the rim structure taken along the lines IV—IV of FIG. 3.
Figure 2:
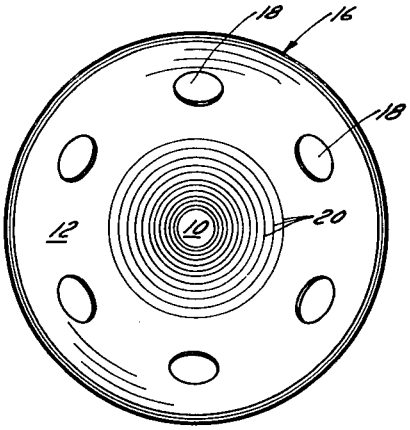
FIG. 2 is a top plan view of FIG. 1.
Figure 3:
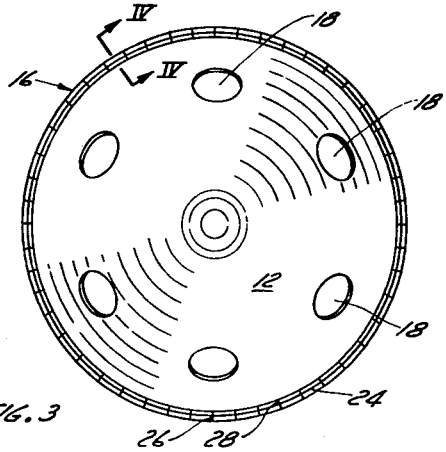
FIG. 3 is a bottom plan view of the device illustrated in FIG. 1.

Referring to FIGS. 1 to 3, it may be seen that toy device T comprises a rounded base 10, a lower portion 12 of the body-forming wall, an upper portion 14 of the body-forming wall, and a rim 16.

Lower portion 12 extends upwardly and outwardly from rounded base 10 and, in the embodiment illustrated, has a generally frusto-conical configuration. The upper portion, on the other hand, is somewhat cylindrical in configuration for reasons to be discussed hereinafter. Both portions 14 and 12 have a plurality of apertures 18 therein so that, should the device, in one manner or another, be placed on top of the child, no danger of suffocation occurs. In this respect, apertures 18 are illustrated as being relatively large; it will be understood that substantially smaller apertures may be used.

On the interior surface of portion 12, there is provided a plurality of concentric ribs 20 such that, when the child sits or kneels in the device, the same will prevent him from sliding out of the toy.

The rim portion 16 is a continuation of portion 14 and is curved outwardly as designated by reference numeral 22. Intermediate to portion 22 and portion 14, a rib 24 is provided and which is interconnected by further reinforcing ribs 26 and 28.

Figure 5:
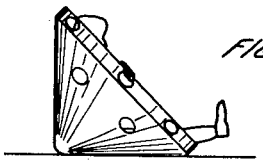
FIGS. 5 and 6 illustrate the device in use. Referring to the drawings in greater detail and by reference characters thereto, reference character T designates one embodiment of the present invention.
Figure 6:
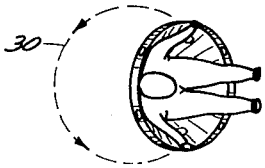

As may be seen from FIGS. 5 and 6, the child may sit in the device and grasp rim 16 and upper portion 14 and roll the device in a circle or otherwise, by a rocking motion, achieve travel from one point to a further point. As will be seen from FIG. 5, upper portion 14 is not in contact with the supporting surface and thus, the child's hands are in no danger of being injured by being caught between the device and the supporting surface.

Alternatively, portion 12 may extend at a constant angle and means may be provided on the interior surface of portion 12 for the child to grasp and hold on. Still further, portion 14 may be shaped in many different ways with the proviso that the same does not contact the supporting surface when the device is used.

It will be understood that the above description is of a preferred emmbodiment only and that many changes and modifications may be made thereto without departing from the spirit and scope of the invention.

I claim:

1. A toy device for children adapted for a rotational and rocking movement on a supporting surface, said toy device consisting of a one-piece integral member of a plastics material having a lower portion and an upper portion, said lower portion forming a base seating area adapted to receive a child in a seating position, said lower portion being of a frusto-conical configuration having inwardly and downwardly tapering side walls meeting at a rounded apex, said rounded apex forming a pivot point about which said device rotates, said side walls tapering inwardly at a constant agle such that the exterior surface of said side walls of said lower frusto-conical portion contacts a planar supporting surface along substantially their entire length whereby said device may be rolled and rotated about said pivot point on the exterior surface of said side walls, said side walls having an interior surface with a plurality of concentric ribs formed thereon, said upper portion having a generally cylindrical configuration, the upper portion extending upwardly from said lower portion a distance sufficient to protect the hand of a child from contact with the supporting surface when said device is rolled and rotated with said walls of said lower frusto-conical portion in contact therewith, an upper portion of said lower frusto-conical portion and said cylindrical upper portion having a plurality of apertures formed therein to provide means for entry of air when said device is overturned.

2. The device of claim 1, wherein said inwardly and downwardly tapering side walls taper inwardly at an angle of approximately 45°.

3. The device of claim 2, including at least one handle on the interior surface of said cylindrical upper portion.

* * * * *